US010308402B2

(12) United States Patent
Wada et al.

(10) Patent No.: US 10,308,402 B2
(45) Date of Patent: Jun. 4, 2019

(54) SPOUT STOPPER AND PACKAGING CONTAINER

(71) Applicant: TOPPAN PRINTING CO., LTD., Taito-ku, Tokyo (JP)

(72) Inventors: Kiyoshi Wada, Tokyo (JP); Takekuni Seki, Tokyo (JP); Nobukazu Fujiwara, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 132 days.

(21) Appl. No.: 15/328,988

(22) PCT Filed: Jul. 30, 2015

(86) PCT No.: PCT/JP2015/003851
§ 371 (c)(1),
(2) Date: Jan. 25, 2017

(87) PCT Pub. No.: WO2016/017178
PCT Pub. Date: Feb. 4, 2016

(65) Prior Publication Data

US 2017/0225851 A1 Aug. 10, 2017

(30) Foreign Application Priority Data

Jul. 30, 2014 (JP) ..... 2014-155136
Jul. 30, 2014 (JP) ..... 2014-155137
(Continued)

(51) Int. Cl.
*B65D 5/74* (2006.01)
*B65D 41/04* (2006.01)
(Continued)

(52) U.S. Cl.
CPC ..... *B65D 47/121* (2013.01); *B65D 5/746* (2013.01); *B65D 41/0421* (2013.01);
(Continued)

(58) Field of Classification Search
CPC .. B65D 47/121; B65D 51/20; B65D 41/0421; B65D 5/746; B65D 47/123; B65D 47/103; B65D 2251/0093; B65D 2251/0015
See application file for complete search history.

(56) References Cited

U.S. PATENT DOCUMENTS

2012/0234848 A1 9/2012 Muramoto et al.

FOREIGN PATENT DOCUMENTS

JP S50-041950 U1 4/1975
JP H05-305941 A 11/1993
(Continued)

OTHER PUBLICATIONS

International Search Report dated Oct. 20, 2015 in International Patent Application No. PCT/JP2015/003851, 2 pages.

*Primary Examiner* — James N Smalley
(74) *Attorney, Agent, or Firm* — Squire Patton Boggs (US) LLP

(57) ABSTRACT

Provided are a spout stopper that prevents a decrease in sealing performance to a cap without deterioration of liquid-shutting-off performance of a stopper body, and a packaging container using the spout stopper. The spout stopper includes: a stopper body including a cylindrical side wall; and a cap to be mounted from an upper end side that is one end of the side wall. A projection is formed at an upper end edge of the side wall so as to project outward from the side wall, and a top surface at an upper end of the side wall is in surface contact with a predetermined contact surface inside
(Continued)

a cap over an entire circumference thereof in a state where the cap is mounted on the side wall.

17 Claims, 9 Drawing Sheets

(30) Foreign Application Priority Data

| | | |
|---|---|---|
| Aug. 22, 2014 | (JP) | 2014-169413 |
| Sep. 30, 2014 | (JP) | 2014-201214 |
| Jul. 22, 2015 | (JP) | 2015-145233 |
| Jul. 22, 2015 | (JP) | 2015-145234 |
| Jul. 22, 2015 | (JP) | 2015-145235 |
| Jul. 22, 2015 | (JP) | 2015-145236 |

(51) Int. Cl.
*B65D 47/10* (2006.01)
*B65D 51/20* (2006.01)
*B65D 47/12* (2006.01)

(52) U.S. Cl.
CPC ..... *B65D 47/103* (2013.01); *B65D 47/123* (2013.01); *B65D 51/20* (2013.01); *B65D 2251/0015* (2013.01); *B65D 2251/0093* (2013.01)

(56) References Cited

FOREIGN PATENT DOCUMENTS

| | | | |
|---|---|---|---|
| JP | H07-309336 | A | 11/1995 |
| JP | H10-001156 | A | 1/1998 |
| JP | H10-157731 | A | 6/1998 |
| JP | H10-167297 | A | 6/1998 |
| JP | H11-171233 | A | 6/1999 |
| JP | H11-310231 | A | 11/1999 |
| JP | 2001-233365 | A | 8/2001 |
| JP | 2003-020053 | A | 1/2003 |
| JP | 2004-051126 | A | 2/2004 |
| JP | 2004-067101 | A | 3/2004 |
| JP | 2004-149164 | A | 5/2004 |
| JP | 2004-331221 | A | 11/2004 |
| JP | 2007-238140 | A | 9/2007 |
| JP | 2008-018971 | A | 1/2008 |
| JP | 2008-255319 | A | 10/2008 |
| JP | 2011-052040 | A | 3/2011 |
| JP | 2011-105383 | A | 6/2011 |
| JP | 2011-111218 | A | 6/2011 |
| JP | 2011-116393 | A | 6/2011 |
| JP | 2012-245997 | A | 12/2012 |
| JP | 2013-177202 | A | 9/2013 |
| WO | WO 2011/078085 | A1 | 6/2011 |

A - A'

SPOUT STOPPER AND PACKAGING CONTAINER

TECHNICAL FIELD

The present invention relates to a spout stopper and a packaging container.

BACKGROUND ART

A technique is known in which a spout stopper (spout) having a screw portion is provided at a pour-out port of a container body for a product such as beverage, liquid seasoning, or cosmetic and the pour-out port is closed by a cap having a screw portion formed so as to be able to be brought into threaded engagement with the screw portion of the spout stopper. With the spout stopper and the cap, capping is enabled to be repeatedly performed, by bringing the screw portions into threaded engagement with each other even after the cap is removed for opening.

Patent Literature 1 discloses a cap body including a contact ring and an inner ring that are provided on the inner surface of the cap body at the sealing side and are brought into engagement with an end of a pour-out port body (spout stopper) at a pour-out port to enhance sealability.

Patent Literature 2 discloses a stopper including a spout having an end portion that is formed so as to spread at the same angle as the inclination angle of an inclined plate of a paper container, whereby when a content liquid is poured out, running-down of the liquid is less likely to occur and shutting-off of the liquid is good.

For mounting a spout stopper made of a resin material to a container body, an ultrasonic welding method is often used in which ultrasonic vibration is applied to a flange of the spout stopper to weld the flange.

Patent Literature 3 discloses a spout stopper (stopper with a pull ring) in which a cut-off portion (annular opening) is provided near the inner edge of a flange surface, whereby vibration occurring during ultrasonic welding is inhibited from being transmitted to a half-cut portion (annular thin brittle line) of a partition (blocking plate) that closes the spout stopper, thereby preventing occurrence of a crack.

Patent Literature 4 discloses a technique in which, in the above-described spout stopper having the cut-off portion, in order to inhibit projections, which are provided at equal intervals in the circumferential direction of a side wall for holding a container body between a flange and the projections, from being deformed by the energy of ultrasonic vibration, ribs are provided on the inner surface of the cut-off portion and at positions corresponding to the projections, whereby the energy of the ultrasonic vibration is dispersed and absorbed.

CITATION LIST

Patent Literature

[PTL 1] Japanese Laid-Open Patent Publication No. 2004-331221

[PTL 2] Japanese Laid-Open Patent Publication No. 2008-018971

[PTL 3] Japanese Laid-Open Patent Publication No. 2004-067101

[PTL 4] Japanese Laid-Open Patent Publication No. 2011-105383

SUMMARY OF THE INVENTION

Problems to be Solved by the Invention

However, in the case of mounting the spout to the container body by welding, a low-density polyethylene resin is often used as the material of the spout, and a polypropylene resin or a high-density polyethylene, which is a material harder than the low-density polyethylene resin, etc. is often used as the material of the cap. In the case where such materials are used, when a contact ring is formed in the cap, a trace of engagement of the contact ring is likely to remain on a contact portion of the spout with the contact ring. Particularly, a trace of engagement of the contact ring remaining on the spout remains as a circumferential V-shaped groove at the upper end of the spout, and causes deterioration of performance of shutting off a content liquid being poured out.

The present invention has been made in view of the above-described problem, and an object of the present invention is to provide a spout stopper that prevents a decrease in sealing performance to a cap without deterioration of liquid-shutting-off performance of a stopper body, and a packaging container using the spout stopper.

In addition, such a stopper is often fixed to a packaging container by welding and used. Thus, for the purpose of enhancing sealability between the spout stopper and the packaging container after welding, a low-density polyethylene resin (LDPE, L-LDPE) is often used as the material of the spout. In such a case, a polypropylene resin or a high-density polyethylene resin, which has higher rigidity than the low-density polyethylene resin, etc. is used as the material of the cap, whereby sealability between the spout and the cap can be enhanced.

However, when the rigidity of the cap is higher than the rigidity of the spout, if an excessive torque is applied to the spout and the cap, the spout having lower rigidity falls down in the inner peripheral direction due to a load received from an internal screw of the cap, so that "overrun" that the internal screw climbs over a screw portion of the spout may occur. When overrun occurs, threaded engagement with the cap becomes imperfect, so that the content liquid is likely to leak. In addition, by an external screw of the spout being partially scraped by the screw portion of the cap due to the overrun, play (a gap) may occur in the threaded engagement, resulting in a decrease in the sealing performance of the spout stopper.

The present invention has been made in view of the above-described problem, and an object of the present invention is to provide a spout stopper that can inhibit occurrence of overrun even when an excessive torque is applied to a cap and a stopper body, and a packaging container using the spout stopper.

Moreover, in the case of such a stopper, in threaded attachment between the screw portions, unless the cap is threadedly attached to the spout such that the screw axes of the cap and the spout coincide with each other, and then the cap is rotated, the screw portions are less likely to be brought into threaded engagement with each other in a state where the screw portions are properly in mesh with each other. In a state where the screw axes of the cap and the spout do not coincide with each other so that the cap is tilted relative to the spout, if a user attempts to forcedly rotate the cap, a threaded engagement failure is likely to occur, for example, threaded engagement cannot be successfully achieved, or the cap is fixed to the spout in an incomplete state where screw threads thereof are not properly in mesh with each other.

In addition, the screw portion of the cap is likely to come into contact with a liquid-running-down prevention shape at the spout end or the like before coming into contact with the screw portion of the spout. Thus, even when the user attempts to threadedly attach the cap to the spout stopper such that the central axes of the cap and the spout coincide with each other, the attitude of the cap is changed by the screw portion of the cap coming into contact with the liquid-running-down prevention shape, so that the cap may not be properly brought into threaded engagement with the spout, causing a threaded engagement failure.

The present invention has been made in view of the above-described problem, and an object of the present invention is to provide a spout stopper that can prevent occurrence of a threaded engagement failure of screw portions of a cap and the spout stopper, and a packaging container using the spout stopper.

Furthermore, as in Patent Literature 3 or 4, there is a proposal to provide a cut-off portion and a rib in order to inhibit deformation of each portion of a spout stopper during ultrasonic welding. However, suitable design for the cut-off portion and the rib has not been sufficiently examined.

The present invention has been made in view of the above-described problem, and an object of the present invention is to provide a spout stopper that can favorably inhibit each portion from deforming due to ultrasonic welding, and a packaging container using the spout stopper.

Solution to the Problems

An aspect of the present invention for solving the above-described problem is a spout stopper including: a stopper body including a cylindrical side wall; and a cap to be mounted from an upper end side that is one end of the side wall, wherein a projection is formed at an upper end edge of the side wall so as to project outward from the side wall, and a top surface at an upper end of the side wall is in surface contact with a predetermined contact surface inside the cap over an entire circumference thereof in a state where the cap is mounted on the side wall.

Another aspect of the present invention for solving the above-described problem is a spout stopper including a stopper body including a cylindrical side wall having an external screw formed on an outer circumferential surface thereof; and a cap including a cylindrical side wall having an internal screw formed on an inner circumferential surface thereof, the cap being to be mounted from an upper end side that is one end of the side wall of the stopper body, wherein a disc-shaped flange is formed at a lower end of the side wall of the stopper body so as to extend outward from a lower end edge of the side wall of the stopper body, and the external screw is formed in a range along a screw axis direction from a connection position at which the side wall of the stopper body is connected to the flange to a distance that is not less than ⅓ of a distance between the connection position and the upper end edge and not greater than ⅔ of the distance between the connection position and the upper end edge.

Another aspect of the present invention for solving the above-described problem is a spout stopper including: a stopper body including a cylindrical side wall; and a cap to be mounted from an upper end side that is one end of the side wall, wherein an outer circumferential surface of the side wall includes an external screw portion on which an external screw is formed, and a guide portion that is a region at an upper end side with respect to the external screw portion and on which the external screw is not formed, an inner circumferential surface of the cap includes an internal screw portion on which an internal screw to be brought into threaded engagement with the external screw is formed, and a distance along a screw axis direction between a formation start position that is an upper end of the internal screw and a formation end position that is a lower end of the internal screw is shorter than a guide portion length that is a distance from the upper end edge of the side wall to a formation start position at an upper end side of the external screw.

Another aspect of the present invention for solving the above-described problem is a spout stopper including: a cylindrical side wall; a partition closing an interior of the side wall and having a half-cut formed at an outer peripheral portion; a disc-shaped flange provided so as to extend outward from a lower end edge of the side wall; a groove-shaped cut-off portion provided on a surface of the flange opposite to the side wall so as to be concentric with the side wall; and a plurality of ribs provided on an inner surface of the cut-off portion, wherein an interval between each of the plurality of ribs and the rib adjacent thereto along a circumferential direction of the cut-off portion is not less than 0.5 mm and not greater than 5.0 mm.

Another aspect of the present invention is a packaging container including a container body and the above spout stopper mounted on the container body.

Advantageous Effects of the Invention

The spout stopper according to the present invention can prevent a decrease in sealing performance to the cap without deterioration the liquid-shutting-off performance of the stopper body, can inhibit occurrence of overrun even when an excessive torque is applied to the cap and the stopper body, can prevent a threaded engagement failure of the screw portions of the cap and the stopper body, and can inhibit each portion from deforming due to ultrasonic welding.

The present invention can provide a packaging container using such a spout stopper.

DESCRIPTION OF EMBODIMENTS

Figure 1A:
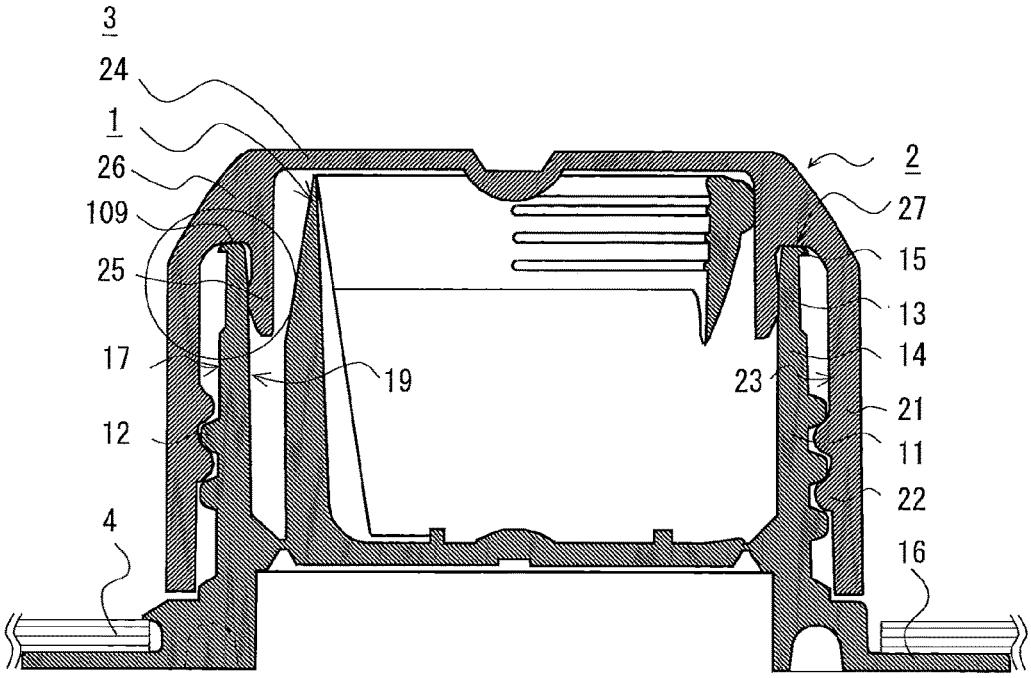
FIG. 1A is a cross-sectional view showing a spout stopper according to an embodiment of the present invention.
Figure 1B:
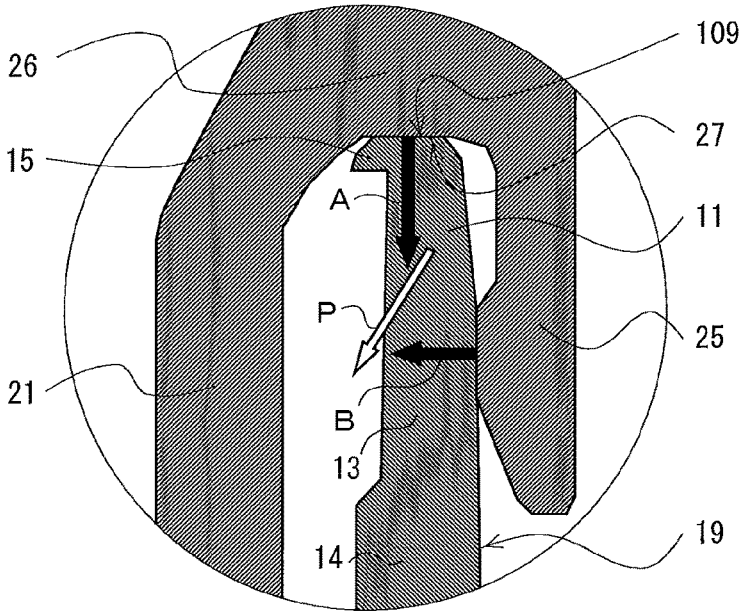
FIG. 1B is a cross-sectional view showing a spout stopper according to an embodiment of the present invention.
Figure 2:
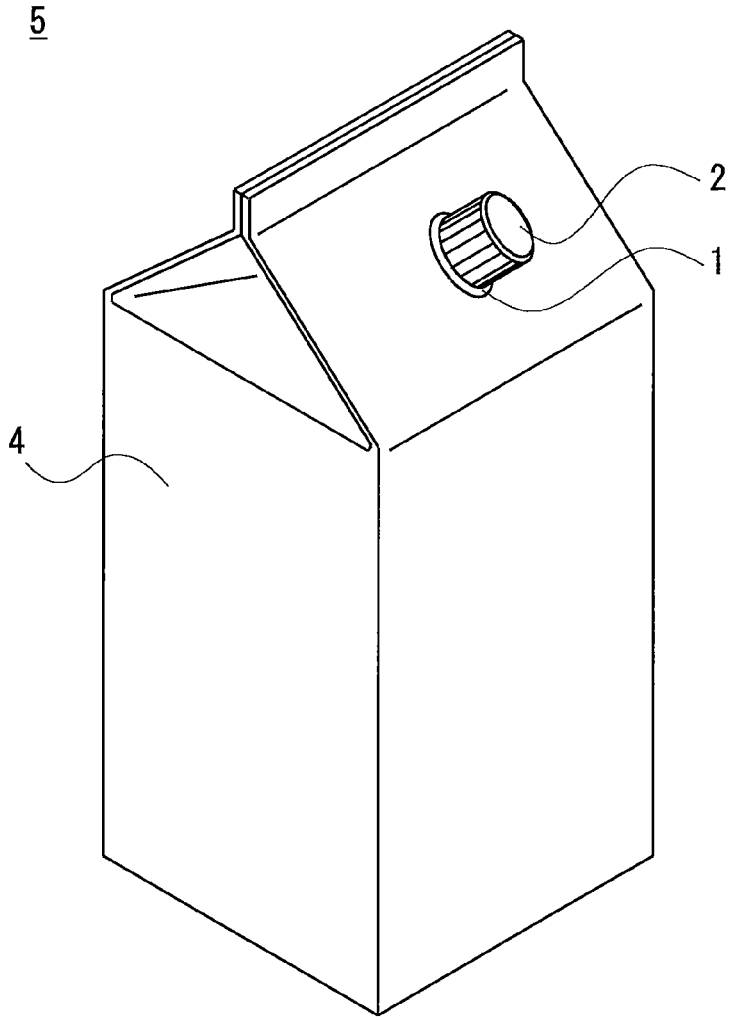
FIG. 2 is a perspective view showing a packaging container according to the embodiment of the present invention.

A spout stopper 3 and a packaging container 5 according to an embodiment of the present invention will be described with reference to FIGS. 1A, 1B and 2. FIGS. 1A and 1B show a cross-sectional view of the spout stopper 3 that includes a stopper body 1 and a cap 2. FIG. 2 shows a perspective view of the packaging container 5 that includes: the spout stopper 3 including the stopper body 1 and the cap 2; and a container body 4. In the present specification, "threaded engagement" means that screw threads of the cap and of a side wall of the stopper body are caused to be in mesh with each other and are rotated relative to each other in the circumferential direction, thereby fitting (mounting) the cap and the stopper body to each other. In addition, "screw axis" means a virtual line that is present on the center of a circumference forming the screw thread and extends in a direction in which the cap moves in bringing the cap and the stopper body into threaded engagement with each other.

First, the spout stopper 3, the stopper body 1, and the cap 2 will be described.

As shown in FIGS. 1A and 1B, the spout stopper 3 includes the stopper body 1 and the cap 2. The stopper body 1 includes a cylindrical side wall 11. The side wall 11 has a top surface 109 formed at the upper end side which is one end. The cap 2 includes a cylindrical side wall 21, a top plate 24, and a contact surface 27 formed so as to be perpendicular to the screw axis of the cap 2. The cap 2 is mounted from the upper end side of the side wall 11 of the stopper body 1. A projection 15 is formed at the upper end edge of the side wall 11 so as to project outward from the side wall 11. The top surface 109 at the upper end of the side wall 11 is in surface contact with the contact surface 27 of the cap 2 in a state where the cap 2 is mounted on the side wall 11 of the stopper body 1. Since the projection 15 is formed so as to project outward from the upper end edge of the side wall 11 of the stopper body 1, liquid-shutting-off performance exerted when a content liquid is poured out can be improved to prevent the content liquid from running down on the outer circumferential surface of the side wall 11 at the time of pouring-out to make the stopper body 1 dirty. The upper end of the side wall 11 of the stopper body 1 refers to the upper side of the side wall 11 in the sheet of FIGS. 1A and 1B.

A disc-shaped flange 16 is formed at the lower end edge of the side wall 11 of the stopper body 1 so as to extend outward. The flange 16 is a location where the container body 4 and the spout stopper 3 are joined to each other in producing the packaging container 5 including the container body 4 and the spout stopper 3 mounted on the container body 4 as shown in FIG. 2. As the joining method, ultrasonic welding may be used.

A cylindrical first outer diameter portion 13 and a cylindrical second outer diameter portion 14 having a larger outer diameter than the first outer diameter portion 13 are provided below the projection 15, which is provided at the upper end of the side wall 11 of the stopper body 1. On an outer circumferential surface 17 of the second outer diameter portion 14, an external screw 12 is formed which can be brought into threaded engagement with an internal screw 22 of the cap 2 described later.

As shown in FIGS. 1A and 1B, the cap 2 includes: the cylindrical side wall 21 having an inner circumferential surface 23 on which the internal screw 22 is formed; and the top plate 24 that covers the side wall 21 from the upper end side. The side wall 21 and the top plate 24 are connected to each other by a thick portion 26 that is provided from the upper end side of the side wall 21 to the outer periphery of the top plate 24 of the upper end side. On the inner circumferential surface 23 of the side wall 21, the internal screw 22 is formed which can be brought into threaded engagement with the external screw 12, which is formed on the side wall 11 of the stopper body 1. Inside the cap 2, a cylindrical inner ring 25 is formed adjacently with the thick portion 26 such that an end thereof is in contact with the top plate 24. The contact surface 27 perpendicular to the screw axis is formed at the lower end of the thick portion 26.

As shown in FIG. 1B, the height of the contact surface 27 is set such that the top surface 109 of the side wall 11 is in surface contact with the contact surface 27 over the entire circumference thereof in a state where the cap 2 is mounted on the side wall 11 of the stopper body 1, and the side wall 11 becomes elastically deformed upon reception of a compressive load. In addition, the outer circumferential surface of the inner ring 25 is formed such that a part thereof projects over the entire circumference, and is in contact with the inner circumferential surface 19 of the side wall 11 in a state where the cap 2 is mounted on the side wall 11 of the stopper body 1.

In the present embodiment, in mounting the cap 2 onto the side wall 11 of the stopper body 1, after the cap 2 is put on the side wall 11 from the upper end of the side wall 11, the cap 2 is rotated relative to the side wall 11 in the circumferential direction, thereby bringing the external screw 12 and the internal screw 22 into threaded engagement with each other. When the threaded engagement between the external screw 12 and the internal screw 22 is completed, the top surface 109 at the upper end of the side wall 11 is in surface contact with the contact surface 27 of the cap 2, the side wall 11 of the stopper body 1 becomes elastically deformed, and also the outer circumferential surface of the inner ring 25 is in contact with the inner circumferential surface 19 of the side wall 11, as described above.

In the present embodiment, the area of the top surface 109 is increased by the projection 15, whereby a large contact area with the contact surface 27 can be ensured as compared to the conventional art, and sealing performance can be improved.

In addition, when the cap 2 is mounted on the side wall 11 of the stopper body 1, since the contact surface 27 is formed such that the side wall 11 becomes elastically deformed, the top surface 109 is in surface contact with the contact surface 27 at high contact pressure, so that the sealing performance can be improved.

The side wall 11 of the stopper body 1 receives a downward force shown by an arrow A in FIG. 1B at the top surface 109 and the projection 15 from the contact surface 27, and receives an outward force shown by an arrow B in FIG. 1B at an inner circumferential surface 19 from the inner ring 25. Thus, as a force obtained by combining these forces, the side wall 11 receives an obliquely downward force shown by an arrow P in FIG. 1B, and becomes elastically deformed in a direction in which the side wall 11 is pressed and widened. As a result, the side wall 11 of the stopper body 1 is in contact with the cap 2 such that the top surface 109 and the inner circumferential surface 19 are pressed against the contact surface 27 and the outer circumferential surface of the inner ring 25, respectively, by a restoring force of the side wall 11. Therefore, the sealing performance of the stopper body 1 can be further improved. This force falls within a range of elastic deformation, and the side wall 11 immediately returns to the original shape after the cap 2 is opened.

Since the contact pressure of the side wall 11 of the stopper body 1 with respect to the contact surface 27 is increased, a torque (hereinafter, referred to as an opening torque) required for rotation of the cap 2 is increased, so that the cap 2 can be prevented from being loosened. In general, in the case where the lead angle of each screw is made large, the number of rotations required until threaded engagement is completed can be decreased, but the cap becomes easily loosened. However, even with a stopper body having a large lead angle, loosening of the cap can be prevented by applying the present invention. Thus, a stopper body can be provided with which the cap is less likely to become loosened while the number of rotations required until threaded engagement is completed is decreased.

The rigidity of the cap 2 is preferably higher than the rigidity of the side wall 11 of the stopper body 1. For example, a low-density polyethylene resin (LDPE, L-LDPE) may be used as the material of the side wall 11 of the stopper body 1, and a polypropylene resin or a high-density polyethylene resin, etc. may be used as the material of the cap 2. By using the materials having such a relationship, an amount of elastic deformation of the side wall 11 of the stopper body 1 is increased, so that the side wall 11 can be used like a packing, and the sealing performance can be further enhanced.

Figure 3:
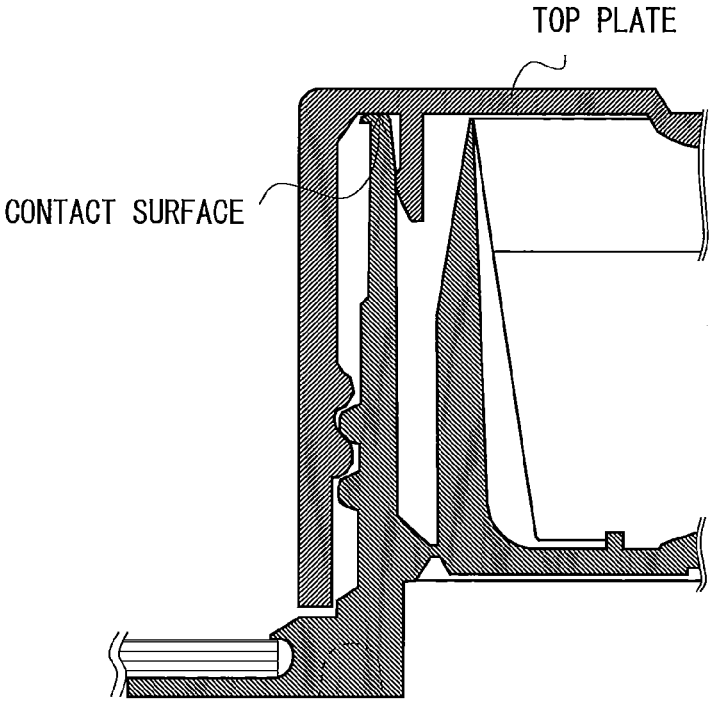
FIG. 3 is a cross-sectional view showing a spout stopper according to a modification of the present invention.

FIG. 3 shows a modification of the present embodiment. In the present embodiment, the lower end of the thick portion 26 is formed as the contact surface 27 parallel to the top plate 24. However, as shown in FIG. 3, a part of the top plate may be formed as a contact surface without providing a portion corresponding to the thick portion 26. The mode of contact between the side wall of the stopper body and the cap is not limited to the above-described embodiment and the modification thereof, and it is needless to say that the position and the shape of the contact surface can be arbitrarily selected as long as the side wall comes into contact with the cap over the entire circumference and a trace of contact that leads to deterioration of the performance of shutting off the content liquid does not remain on the side wall. The shape of the upper end of the side wall of the stopper body may be variously set, for example, in accordance with design of the projection or the like for preventing running-down of liquid. In addition, the shape of the cap can be variously set. Therefore, in accordance with such variety, for example, an upper surface (curved surface or flat surface) that is not exactly the uppermost end such as the top surface at the upper end of the side wall of the stopper body and that is connected to the uppermost end and includes a chamfered portion near the outer side of the uppermost end, or an outer end portion of a projection in the case where the projection is provided, may come into contact with a chamfered portion (curved surface or flat surface) that is not exactly a horizontal surface and is near the upper end of the inner circumferential surface of the side wall of the cap.

The external screw 12 of the side wall 11 of the stopper body 1 and the internal screw 22 of the cap 2 may be single-thread screws or multiple-thread screws.

In the present embodiment, screw threads are formed on the cap 2 and the side wall 11 of the stopper body 1, and a screw-cap type stopper body is used in which the screw threads are brought into threaded engagement with each other. However, the stopper body may be of any type, as long as the stopper body can be sealed by the top surface 109 of the side wall 11 and the contact surface 27 of the cap 2 being brought into surface contact with each other. For example, the present invention is applicable to a plugging cap in which a stopper body plugged into a container port and a cap for closing the stopper body are connected to each other by a hinge.

The embodiment of the present invention will be described further with reference to FIGS. 4A and 4B.

Figure 4A:
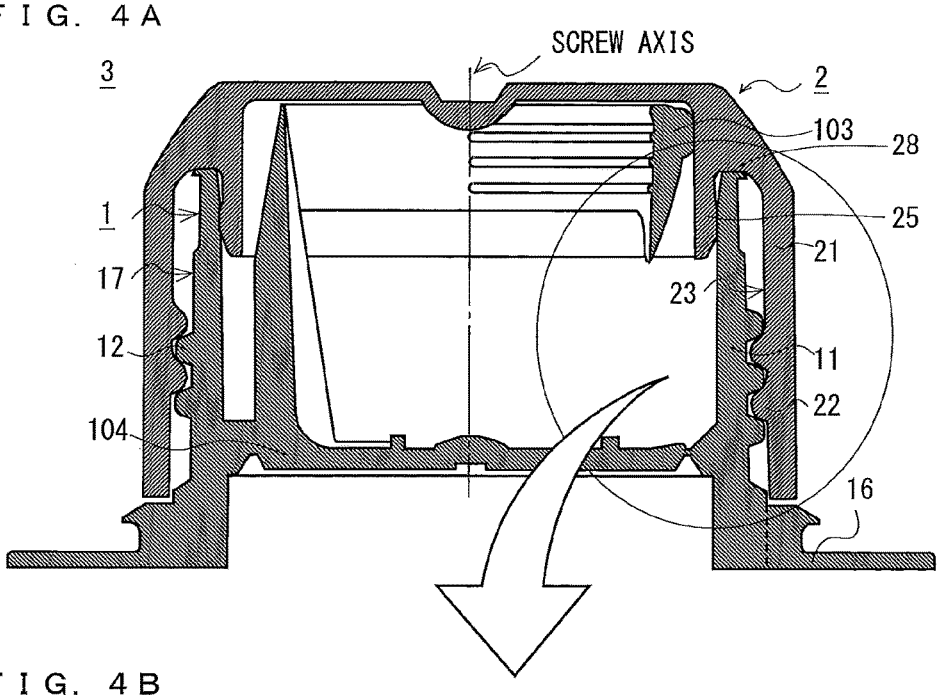
FIG. 4A is a cross-sectional view showing the spout stopper according to the embodiment of the present invention.
Figure 4B:
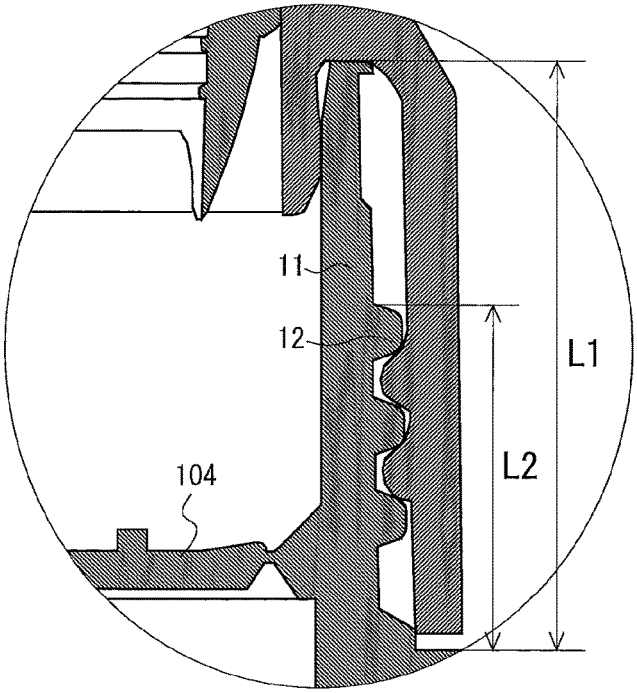
FIG. 4B is a cross-sectional view showing the spout stopper according to the embodiment of the present invention.

FIG. 4A shows a cross-sectional view of the spout stopper 3 in a state where the cap 2 is in threaded engagement, and FIG. 4B shows an enlarged view of a main part thereof. The stopper body 1 includes a partition 104 that is formed at the lower end of the side wall 11 and separates the upper end side and the lower end side of the interior of the side wall 11 from each other. Here, the upper end of the side wall 11 refers to one end at the side at which the cap 2 is threadedly attached (at the upper side in the sheet of FIGS. 4A and 4B).

The partition 104 includes a pull ring 103. The user of the spout stopper 3 can pull out the partition 104 with the pull ring 103, thereby causing the upper end side and the lower end side of the side wall 11 to communicate with each other to form an opening.

Between the inner ring 25 and the side wall 21, a contact portion 28 is provided which is a region with which an upper end portion of the side wall 11 of the stopper body 1 is in surface contact over the entire circumference thereof. Thus, higher sealability is obtained. The contact portion 28 only needs to be provided such that the upper end portion of the side wall 11 and a portion of the side wall 11 near the upper end portion is in contact with the contact portion 28 in a threadedly attached state, and the contact portion 28 may be provided at any of a portion, near the upper end, of the outer circumferential surface of the inner ring 25 or the inner circumferential surface of the side wall 21 in the cap 2, or a top surface portion between the outer circumferential surface of the inner ring 25 and the inner circumferential surface of the side wall 21.

As shown in FIG. 4B, a range (L2) where the external screw 12 is formed is a range along the screw axis direction of the stopper body 1 from a connection position at which the side wall 11 is connected to the flange 16 to a distance that is not less than ⅓ of the distance (L1) between the connection position and the upper end edge and not greater than ⅔ of the distance (L1). The connection position at which the side wall 11 is connected to the flange 16 is the position of the upper surface of the flange 16. When the height of the upper surface of a portion opposing the lower end of the side wall 21 of the cap 2 is higher than the height of the upper surface of a portion outward of this portion as shown in FIGS. 4A and 4B, the connection position is the position of the upper surface of the portion opposing the lower end of the side wall 21 which portion is the higher portion. In addition, the lower end position at which the external screw 12 is formed may not be exactly the connection position at which the side wall 11 is connected to the flange 16. For example, as a matter of course, a portion of the external screw 12 which portion is in a range where the external screw 12 cannot be engaged with the internal screw 22 may not be formed. In this case, the lower end position of the external screw 12 may be a position higher than the connection position with the flange 16 by about 1 pitch of the screw thread.

Overrun that the external screw 12 and the internal screw 22 climb over each other is likely to occur by the internal screw 22 being pushed inward in the case where the rigidity of the stopper body 1 is lower than the rigidity of the cap 2, and such overrun is likely to occur by the cap 2 being pressed and widened outward in the case where the rigidity of the stopper body 1 is higher than the rigidity of the cap 2. In order to inhibit such overrun, the rigidity of the stopper body 1 and the cap 2 is preferably set as follows. For example, the rigidity of the material used for the cap 2 may be higher than the rigidity of the material used for the side wall 11 of the stopper body 1. For example, a polypropylene resin or a high-density polyethylene resin may be used as the material of the cap 2, and a low-density polyethylene resin may be used for the side wall 11 of the stopper body 1. In addition, preferably, the flexural modulus of the material of the cap 2 is, for example, not less than 1000 MPa and not greater than 1500 MPa, and the flexural modulus of the material of the side wall 11 of the stopper body 1 is, for example, not less than 100 MPa and not greater than 200 MPa. If the flexural modulus of the material of the cap 2 is less than 1000 MPa, the cap 2 easily deforms. Thus, when an excessive rotation load is applied to the cap 2, the diameter of the internal screw 22 increases, so that the internal screw 22 easily climbs over the external screw 12 to cause overrun. In addition, if the flexural modulus of the material of the cap 2 is greater than 1500 MPa, the inner ring 25 is less likely to elastically deform, and creep deformation of the inner ring 25 occurs, so that the sealability decreases. If the flexural modulus of the material of the side wall 11 of the stopper body 1 is less than 100 MPa, the side wall 11 easily deforms. Thus, the internal screw 22 easily pushes the side wall 11 of the stopper body 1 inward, so that the internal screw 22 climbs over the external screw 12 to cause overrun. In addition, if the flexural modulus of the material of the side wall 11 is greater than 200 MPa, the side wall 11 is less likely to deform and has a certain degree of strength, so that it is difficult to pull out the partition 104 with the pull ring 103 to form an opening.

Since the external screw 12 is provided in the range from the connection position at which the side wall 11 is connected to the flange 16 to the distance that is not less than ⅓ of the distance (L1) between the connection position and the upper end edge and not greater than ⅔ of the distance (L1), that is, in a range close to a lower portion of the side wall 11 in which range the rigidity is increased by the flange 16 and the partition 104, even when the external screw 12 is pushed by the internal screw 22, the side wall 11 can be less likely to deform inward, and overrun can be less likely to occur.

In the case where the range where the external screw 12 is formed is a range from the connection position at which the side wall 11 is connected to the flange 16 to a distance from that is less than ⅓ of the distance (L1) between the connection position and the upper end edge of the side wall 11, the external screw 12 is brought into engagement with the internal screw 22 of the cap 2 only at a lower end portion of the cap 2 in which lower end portion the diameter easily increases, and also the number of turns of the external screw 12 is reduced, so that sufficient engagement is less likely to be achieved. In addition, in the case where the range where the external screw 12 is formed is a range from the connection position at which the side wall 11 is connected to the flange 16 to a distance that is greater than ⅔ of the distance (L1) between the connection position and the upper end edge of the side wall 11, the portion of the side wall 11 on which portion the external screw 12 is not formed is shortened, and thus no longer sufficiently serves as a guide for causing the rotation axis of the cap 2 and the screw axis of the screw to coincide with each other in inserting the cap 2 to the stopper body 1, so that the screws are less likely to be properly engaged with each other.

The stopper body 1 that is produced by injection molding may be tapered so as to spread from the upper end to the lower end of the side wall 11, in order to improve pulling-out of the stopper body 1 from a mold. Thus, the thickness of the side wall 11 is larger at the lower end than at the upper end, and the rigidity of the side wall 11 is higher at the lower end side. Therefore, in the case where the stopper body 1 is tapered, when the external screw 12 of the stopper body 1 is formed in the above-described range, an effect of inhibiting occurrence of overrun is obtained also by the taper. Similarly, the cap 2 may be tapered so as to spread from the upper end thereof toward the lower end thereof. In this case as well, when the range where the external screw 12 is formed is a range from the connection position at which the side wall 11 is connected to the flange 16 to a distance that is not less than ⅓ of the distance (L1) between the connection position and the upper end edge of the side wall 11, the screws are sufficiently in mesh with each other, and occurrence of overrun can be inhibited.

In a spout stopper according to the conventional art, a method of increasing the number of turns of an external screw on a side wall is adopted in order to enhance the rigidity of the side wall to inhibit overrun. However, in the present embodiment, by forming the external screw 12 in the above-described range, occurrence of overrun can be inhibited. Thus, the number of turns of the external screw 12 on the side wall can be made smaller than that in the conventional art. Thus, as compared to the conventional spout stopper, the user of the spout stopper 3 can easily threadedly engage or disengages the cap 2 with a smaller number of rotations.

At the upper end side of the side wall 11, a region where the external screw 12 is not formed is increased. As a result, this region serves as a guide in fitting the cap 2, so that threaded attachment/threaded engagement of the cap 2 along the screw axis becomes easy. In addition, even when the content liquid adheres to this region, the content liquid is easily wiped off.

The embodiment of the present invention will be described further with reference to FIGS. 5A, 5B, 6A, 6B, 6C and 6D.

Figure 5A:
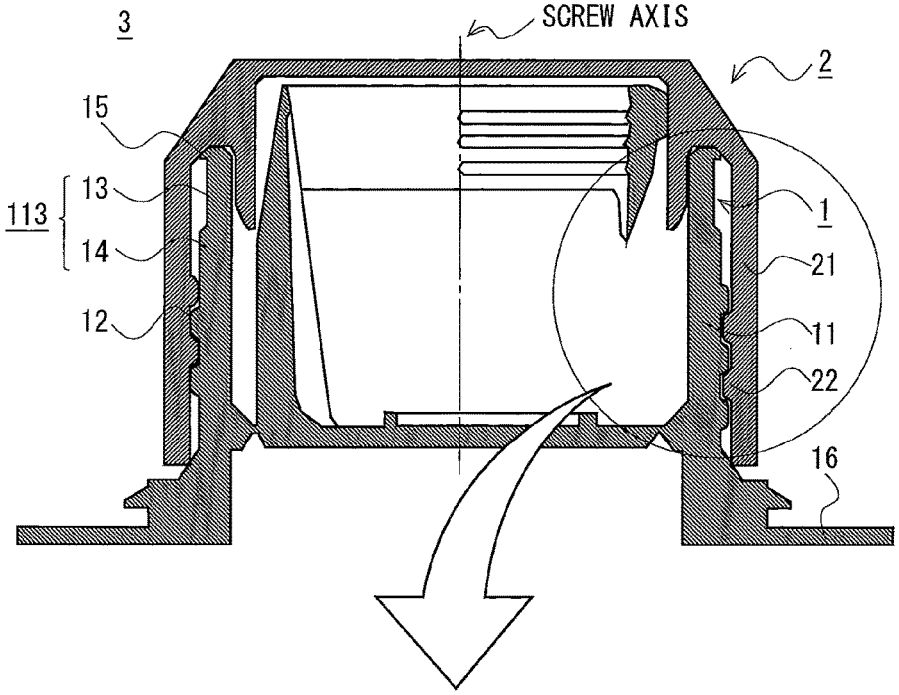
FIG. 5A is a cross-sectional view showing the spout stopper according to the embodiment of the present invention.
Figure 5B:
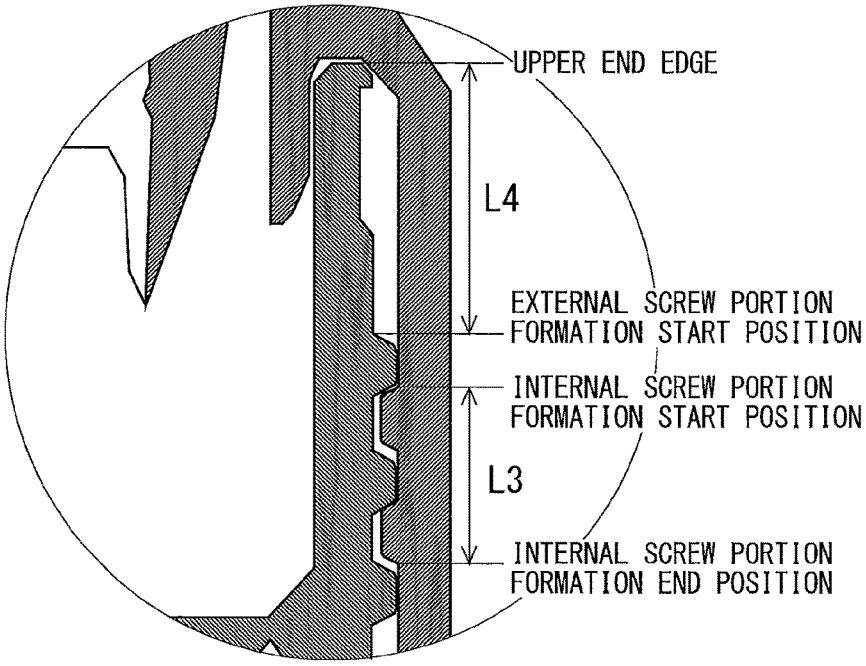
FIG. 5B is a cross-sectional view showing the spout stopper according to the embodiment of the present invention.

FIG. 5A shows a cross-sectional view of the spout stopper 3 in a state where the cap 2 is in threaded engagement, and FIG. 5B shows an enlarged view of a main part thereof. The stopper body 1 includes a guide portion 113 that is a region at the upper end side with respect to the external screw 12 and on which no external screw is formed.

As shown in FIG. 5B, the distance (L3) along the screw axis direction between an internal screw portion formation start position that is the upper end of the internal screw 22 and an internal screw portion formation end position that is the lower end of the internal screw 22 is shorter than the length (L4) of the guide portion 113 that is the distance from the upper end edge of the side wall 11 of the stopper body 1 to an external screw portion formation start position at the upper end side of the external screw 12.

Alternatively, as shown in (c) of FIG. 6, in a state where the cap 2 is fitted to the side wall 11 of the stopper body 1 along the screw axis, the distance (D1) between the inner circumferential surface 23 of the side wall 21 of the cap 2 and the screw thread ridge of the external screw 12 formed on the side wall 11 of the stopper body 1 is shorter than the distance (D2) between the screw thread ridge of the internal screw 22 of the cap 2 and an outer circumferential surface 18 of the guide portion 113.

FIGS. 6A, 6B, 6C and 6D show cross-sectional views each showing a state where the cap 2 is being threadedly attached to the side wall 11 of the stopper body 1.

Figure 6A:
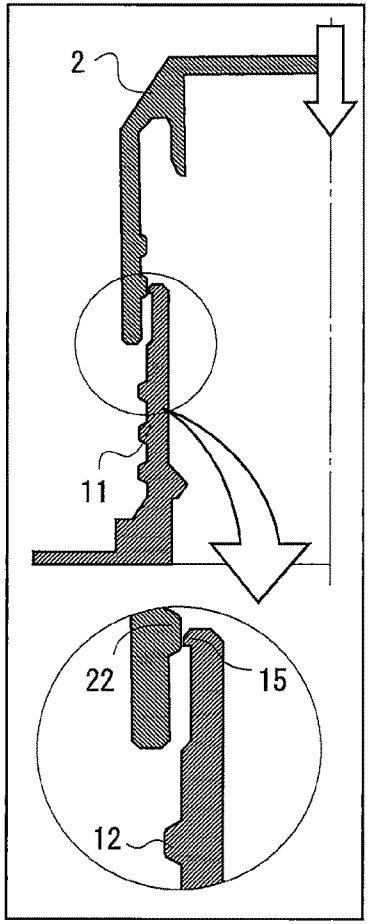
FIG. 6A is a cross-sectional view showing a state where a cap is being threadedly attached to the spout stopper according to the embodiment of the present invention.

Initially, the user puts the cap 2 on the side wall 11 of the stopper body 1 from the upper end (FIG. 6A). At this time, the attitude of the cap 2 may be tilted relative to the screw axis direction due to contact between the projection 15 and the internal screw 22, etc.

Figure 6B:
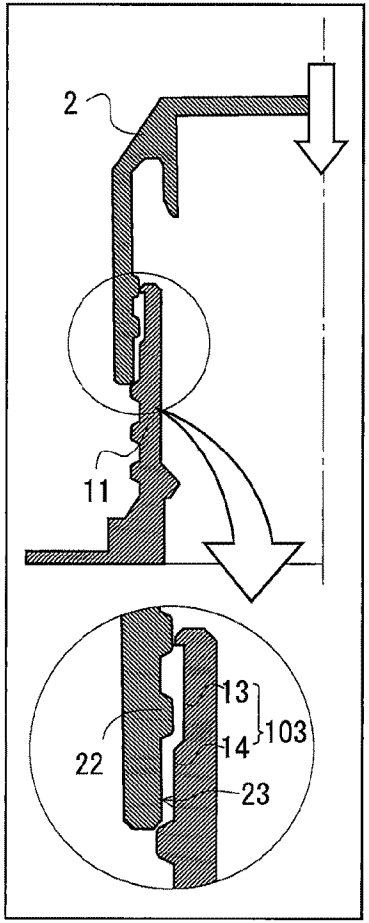
FIG. 6B is a cross-sectional view showing a state where a cap is being threadedly attached to the spout stopper according to the embodiment of the present invention.

Next, the user starts insertion of the cap 2 toward the screw axis direction (FIG. 6B). At the illustrated stage, the internal screw 22 and the external screw 12 are not in contact with each other. In addition, since the internal screw 22 faces the guide portion 113, if an amount of tilt of the cap 2 is greater than a predetermined amount, the internal screw 22 receives resistance by coming into contact with the guide portion 113, and the amount of tilt of the cap 2 is gradually reduced with advance of the insertion.

The guide portion 113 may include, at the lower end side with respect to the projection 15, a portion having an outer diameter increasing toward the external screw 12. For example, the guide portion 113 may include: a first outer diameter portion 13 formed at the lower end side of the projection 15; and a second outer diameter portion 14 that is formed at the lower end side of the first outer diameter portion 13 and at the upper end side of the external screw 12 and has a larger outer diameter than the first outer diameter portion 13. In this case, after moving past the first outer diameter portion 13, the lower end of the cap 2 moves past the second outer diameter portion 14 having a larger outer diameter. Thus, at start of insertion of the cap 2, the cap 2 can be easily inserted since the distance between the lower end of the cap 2 and the first outer diameter portion 13 is large, and during subsequent advance of the insertion, the amount of tilt of the cap 2 can be smoothly reduced since the distance between the lower end of the cap 2 and the second outer diameter portion 14 is small.

Figure 6C:
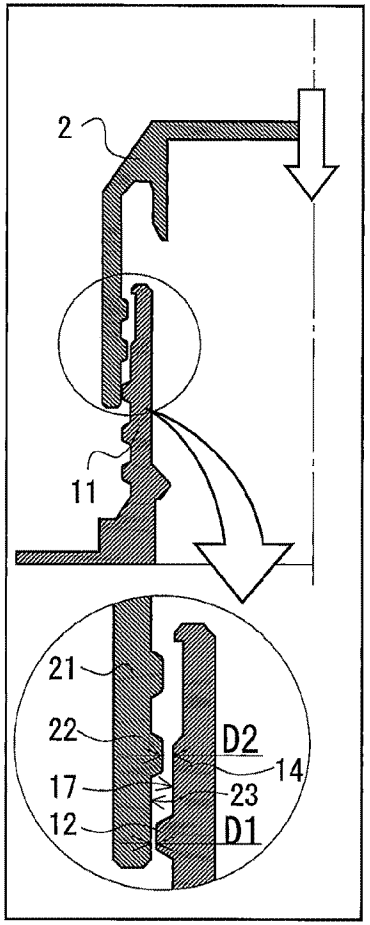
FIG. 6C is a cross-sectional view showing a state where a cap is being threadedly attached to the spout stopper according to the embodiment of the present invention.

The user continues to insert the cap 2 to a position at which the inner circumferential surface 23 of the side wall 21 of the cap 2 faces the screw thread ridge of the external screw 12 of the side wall 11 of the stopper body 1 (FIG. 6C). Since the tilt of the cap 2 has been reduced, the insertion smoothly advances. Even if the tilt has not been completely eliminated, when the inner circumferential surface 23 moves past the screw thread ridge of the external screw 12, the inner circumferential surface 23 comes into contact with the screw thread ridge to receive resistance. Substantially simultaneously with this, the screw thread ridge of the internal screw 22 comes into contact with the outer circumferential surface 17 at the second outer diameter portion 14 to receive resistance. Because of these facts, the amount of tilt of the cap 2 is further reduced with advance of the insertion.

Figure 6D:
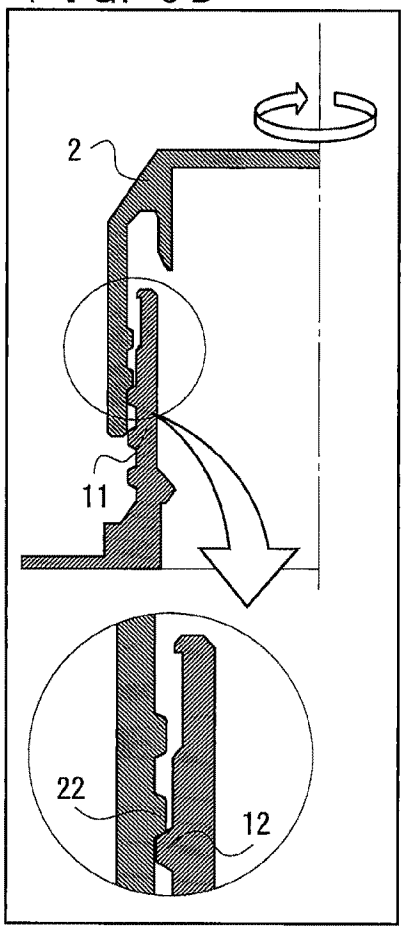
FIG. 6D is a cross-sectional view showing a state where a cap is being threadedly attached to the spout stopper according to the embodiment of the present invention.

The user continues to insert the cap 2 to a position at which the lower end side of the internal screw 22 is in contact with the upper end side of the external screw 12 (FIG. 6D). Accordingly, the internal screw 22 and the external screw 12 are in contact with each other. At this stage, the tilt of the cap 2 relative to the side wall 11 has been eliminated. Thus, when the user rotates the cap 2, the cap 2 and the side wall 11 of the stopper body 1 can be easily brought into threaded engagement with each other without occurrence of a threaded engagement failure.

In the spout stopper according to the present embodiment, the distance (L3) between the formation start position, which is the upper end of the internal screw 22, and the formation end position, which is the lower end of the internal screw 22, is shorter than the guide portion length (L4), which is the distance from the upper end edge of the side wall 11 of the stopper body 1 to the formation start position at the upper end side of the external screw 12. Thus, a distance (L4 or longer) of insertion of the cap 2 from the time when the lower end of the cap 2 moves past the vicinity of the upper end of the side wall 11 of the stopper body 1 to the time when the internal screw 22 of the cap 2 and the external screw 12 of the side wall 11 of the stopper body 1 come into contact with each other can be longer than a distance (about L3) of movement of the cap 2 occurring with subsequent advance of threaded engagement. That is, after the insertion of the cap 2 advances such that the tilt of the cap 2 is assuredly reduced, the internal screw 22 of the cap 2 and the external screw 12 of the side wall 11 of the stopper body 1 can be brought into mesh with each other. In addition, since the distance of insertion is long, the user can be prevented from erroneously determining contact between the projection 15 and the internal screw 22 as contact between the external screw 12 and the internal screw 22 when the projection 15 and the internal screw 22 come into contact with each other at start of insertion, and starting rotation of the cap 2 to cause a threaded engagement failure.

In the spout stopper according to the present embodiment, the distance (D2) between the screw thread ridge of the internal screw 22 of the cap 2 and the outer circumferential surface 17 of the guide portion 113 is preferably longer than the distance (D1) between the inner circumferential surface 23 of the side wall 21 of the cap 2 and the screw thread ridge of the external screw 12 formed on the side wall 11 of the stopper body 1. Accordingly, as shown in FIG. 6C, it is possible to perform alignment of the screw axes with high accuracy (accuracy D1) by interference between the lower end of the cap 2 and the internal screw 22 of the side wall 11 of the stopper body 1. In addition, undesired interference with the side wall 11 of the stopper body 1 can be inhibited at a location other than the lower end of the cap 2 by a certain clearance D2 (>D1), and thus it is possible to more smoothly bring the external screw 12 and the internal screw 22 into mesh with each other in bringing the external screw 12 and the internal screw 22 into threaded engagement with each other.

In the case where each screw portion is formed as a multiple-thread screw, multiple screw threads simultaneously start coming into mesh with each other at time of threaded engagement. Thus, in general, with the multiple-thread screws, an allowable value for an amount of tilt of the cap for preventing occurrence of a threaded engagement failure is smaller as compared to the case with single-thread screws. Therefore, a particularly significant effect is obtained when the present invention is used for a spout stopper in which multiple-thread screws are formed.

Even if the cap and the upper end of the side wall come into contact with each other to tilt the cap in fitting the cap to the side wall, this tilt can be corrected. Thus, limitation on the shape of the upper end of the side wall is reduced. For example, a projecting amount of the projection for preventing running-down of liquid can be increased within the range of the inner diameter of the cap, and the outer diameter of the upper end of the side wall can be larger than the outer diameter of the external screw.

Figure 7:
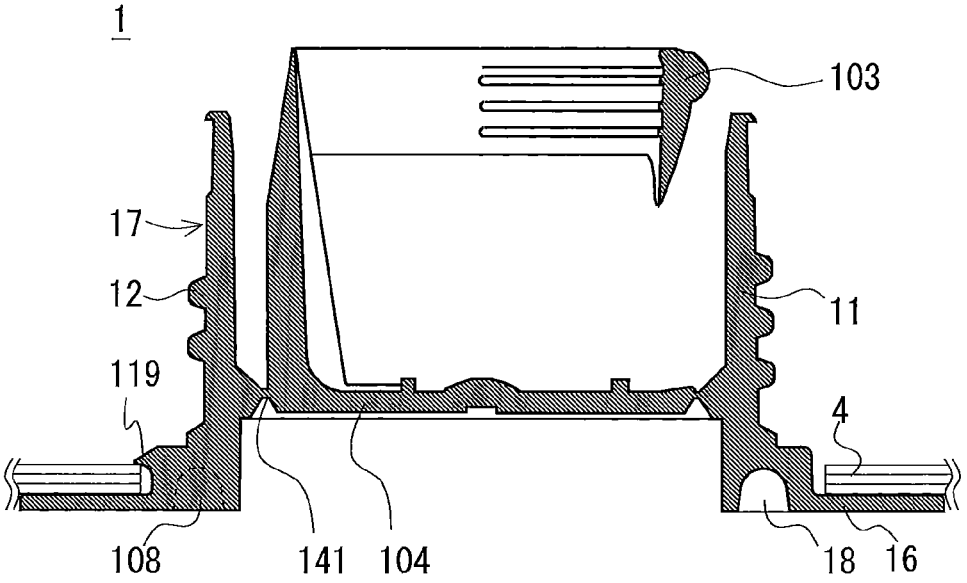
FIG. 7 is a cross-sectional view showing the spout stopper according to the embodiment of the present invention.
Figure 8A:
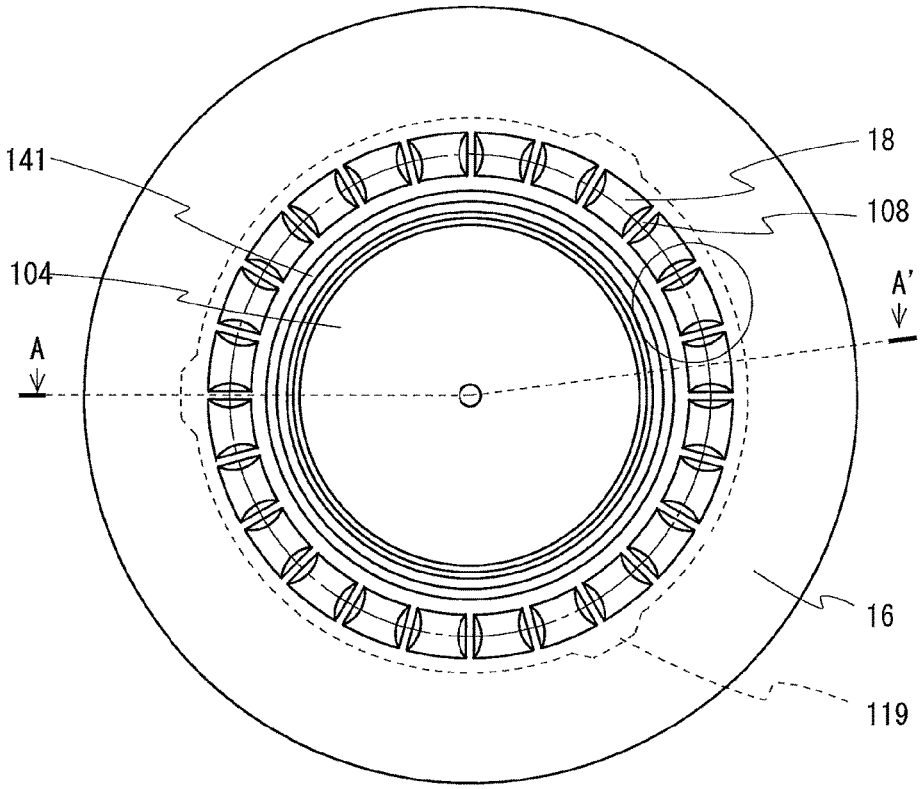
FIG. 8A is a bottom view showing the spout stopper according to the embodiment of the present invention.
Figure 8B:
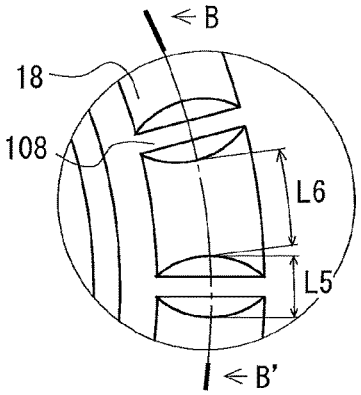
FIG. 8B is an enlarged view showing the spout stopper according to the embodiment of the present invention.
Figure 8C:
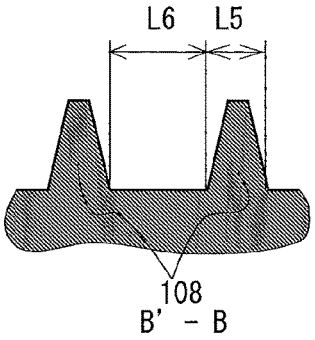
FIG. 8C is a partial cross-sectional view showing the spout stopper according to the embodiment of the present invention.

The embodiment of the present invention will be described further with reference to FIGS. 7, 8A, 8B, and 8C. FIG. 7 shows a cross-sectional view of the stopper body 1. FIG. 8A shows a bottom view of the stopper body 1, FIG. 8B shows an enlarged view of ribs 108, and FIG. 8C shows a cross-sectional view of the rib 108 taken along a line B-B' (see FIG. 8B) in the circumferential direction. The cross-section shown in FIG. 7 is a vertical cross-section along a line A-A' shown in FIG. 8A.

The stopper body 1 includes: the cylindrical side wall 11; the partition 104 that closes the interior of the side wall 11 and has a half-cut 141 formed in an outer peripheral portion thereof; the disc-shaped flange 16 that is provided so as to extend outward from the lower end edge of the side wall 11; a groove-shaped cut-off portion 18 that is provided on a surface of the flange 16 opposite to the side wall 11 so as to be concentric with the side wall 11; and a plurality of ribs 108 that are provided on the inner surface of the cut-off portion 18. Here, the lower end of the side wall 11 refers to the lower side in the sheet of FIG. 1. As shown in FIG. 7 and FIG. 8A, three projections 119 are formed on the side wall 11 at the upper end side with respect to the flange 16 at circumferentially equal intervals so as to project outward from the side wall 11. The number of the projections 119 may be larger than three.

The partition 104 is connected to the side wall 11 via the half-cut 141 formed annually by decreasing the thickness of the outer periphery. The pull ring 103 is connected to the partition 104 via a pillar. The user of the stopper body 1 can pull the pull ring 103 upward to break the partition 104 along the half-cut 141 and pull out the partition 104 from the side wall 11, thereby causing the upper end side of the lower end side of the side wall 11 to communicate with each other to form an opening.

The flange 16 is a location where the container body 4 and the spout stopper 3 are joined to each other in producing the packaging container 5 including the container body 4 and the spout stopper 3 mounted on the container body 4 as shown in FIG. 2. As the joining method, ultrasonic welding may be used.

To ultrasonically weld the spout stopper 3 to the container body 4, the side wall 11 of the stopper body 1 is initially inserted into an opening of the container body 4 from the inner surface side such that the upper surface of the flange 16 is brought into contact with the inner surface of the container body 4 as shown in FIG. 7. At this time, the stopper body 1 is provisionally held to the container body 4 by interposing, between the projections 119 and the flange 16, a portion surrounding the opening of the container body 4. Then, an anvil and an ultrasonic horn (both are not shown) that have been inserted into the interior (inner side) of the container body 4 are brought into contact with the container body 4 that has overlapped the flange 16, and ultrasonic vibration is generated to weld the container body 4 and the flange 16 to each other. The vibration generated at this time is transmitted from the flange 16 through the side wall 11 to the partition 104 but a part of the vibration is absorbed by the cut-off portion 18.

The cut-off portion 18 is a groove that is provided on the surface of the flange 16 opposite to the side wall 11 so as to be concentric with the outer periphery of the side wall 11. The cross-section of the cut-off portion 18 is, for example, an inverted-U shape (dome shape) that is resistant to ultrasonic vibration and has a rounded top surface as shown in FIG. 7. The cut-off portion 18 inhibits (disperses) propagation of the ultrasonic vibration to the partition 104, thereby preventing occurrence of a crack in the half-cut 141 of the partition 104.

As shown in FIGS. 8A, 8B and 8C, the ribs 108 are provided so as to be aligned on the inner circumferential surface of the cut-off portion 18. In this case, a length L5 of each of the plurality of ribs 108 (the circumferential length of the rib 108 at the center of the groove width of the cut-off portion 18) along the circumferential direction of the cut-off portion 18 is preferably not less than 0.3 mm, and is further preferably not less than 0.5 mm since production of a mold becomes easy. In addition, L5 is preferably not greater than 1.5 mm. An interval L6 between the ribs 108 adjacent to each other (the circumferential length between the ribs 108 adjacent to each other at the center of the groove width of the cut-off portion 18) is preferably within the range of not less than 0.5 mm and not greater than 5.0 mm. By setting L5 and L6 within these ranges, desired rigidity can be ensured around the cut-off portion 18 while the cut-off portion 18 has a function to inhibit propagation of ultrasonic vibration. Therefore, occurrence of a crack in the half-cut can be inhibited, and deformation such as upward warpage of the outer edge of the flange 16 can be prevented. In addition, the energy of the ultrasonic vibration is absorbed and dispersed to a certain extent by the ribs 108, so that co-vibration is inhibited near the flange 16 or the cut-off portion 18 of the side wall 11, and unevenness of concentration of energy is eliminated. As a result, the flange 16 or the side wall 11 can be inhibited from deforming so as to wave. In the example shown in FIGS. 8A, 8B and 8C, the entire circumference of the cut-off portion 18 is divided into 24 segments by 24 ribs 108, and, for example, is preferably divided into 6 to 30 segments by 6 to 30 ribs. In the case where L5 is shorter than 0.3 mm, or in the case where L6 is longer than 5.0 mm, or in the case where the entire circumference of the cut-off portion 18 is divided into 5 or less segments, the proportion of a region filled with the ribs 108 in the entire circumference of the cut-off portion 18 is low, and sufficient rigidity is less likely to be ensured. In addition, in the case where L5 is longer than 1.5 mm, or in the case where L6 is shorter than 0.5 mm, or in the case where the entire circumference of the cut-off portion 18 is divided into 31 or more segments, the proportion of the region filled with the ribs 108 in the entire circumference of the cut-off portion 18 is high, so that an effect of inhibiting propagation of ultrasonic vibration is less likely to be obtained, and also the efficiency of molding decreases. Moreover, when L5 and L6 are made shorter than 0.5 mm, it is difficult to produce a mold, and when L6 is made longer than 5 mm, the above-described warpage or waving occurs.

Due to the above, according to the present invention, it is possible to provide the spout stopper 3 that can inhibit each portion from deforming due to ultrasonic welding, and the packaging container 5 using the spout stopper 3. Furthermore, the productivity can be improved by increasing vibration energy during ultrasonic welding and shortening a vibration cycle. Moreover, cost reduction can be achieved by decreasing the thickness of the half-cut 141.

Figure 9A:
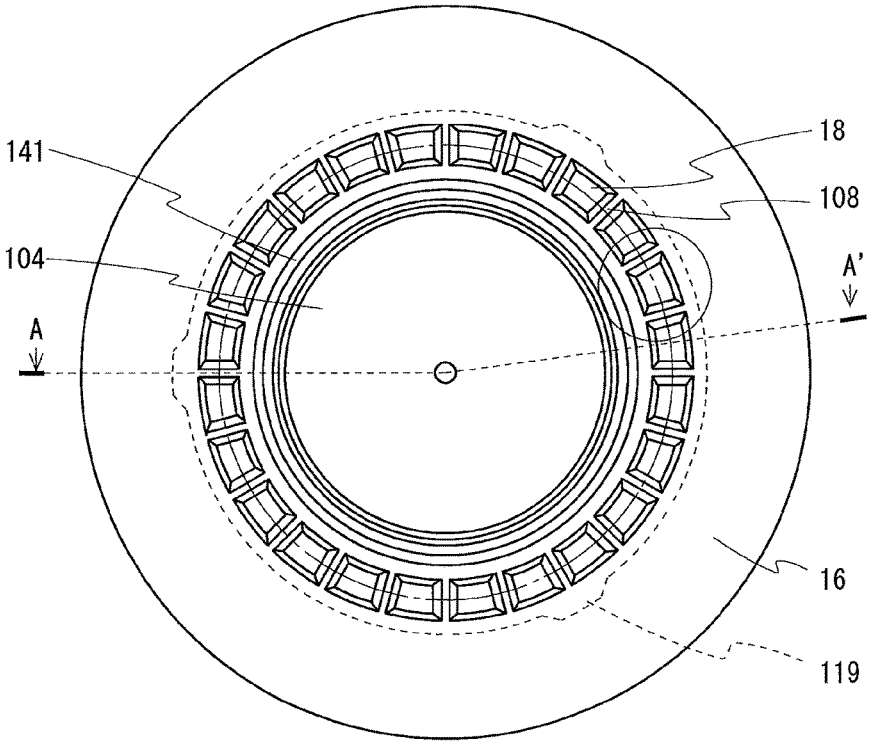
FIG. 9A is a bottom view showing a spout stopper according to a modification of the embodiment of the present invention.
Figure 9B:
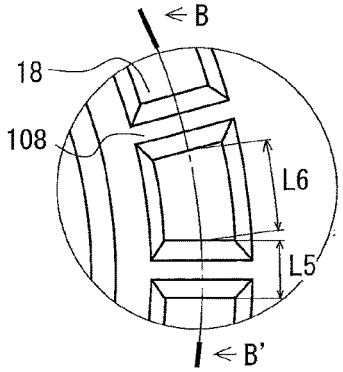
FIG. 9B is an enlarged view showing a spout stopper according to a modification of the embodiment of the present invention.
Figure 9C:
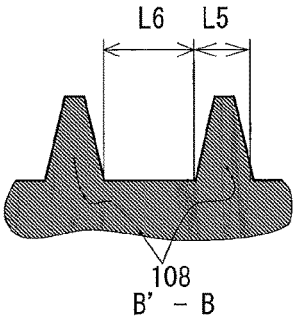
FIG. 9C is a partial cross-sectional view showing a spout stopper according to a modification of the embodiment of the present invention.

The shape of the cut-off portion 18 is not limited to the example shown in FIGS. 8A, 8B and 8C. FIG. 9A shows a bottom view of a stopper body 1 according to a modification, FIG. 9B shows an enlarged view of ribs 108, and FIG. 9C shows a cross-sectional view of the rib 108 taken along a line B-B' (FIG. 9B) in the circumferential direction. In the example shown in FIGS. 8A, 8B and 8C, the cross-sectional shape of the cut-off portion 18 along the line A-A' is a rounded U shape as shown in FIG. 7. However, as in the example shown in FIGS. 9A, 9B and 9C, the cross-sectional shape of the cut-off portion 18 may be a linear shape having a tapered surface and a substantially flat top surface.

Although the embodiment of the present invention has been described above, the present invention is not limited to the above-described embodiment, and can be carried out as a spout stopper obtained by combining some of the features of the above-described embodiment as appropriate, a spout stopper obtained by partially modifying the above-described embodiment, and packaging containers including these spout stoppers.

EXAMPLES

<Evaluation 1>

In order to check the sealing performance of the stopper body, a rotation torque was measured after a cap and a stopper body according to each of examples and reference examples were brought into threaded engagement with each other. Each reference example described later is a modification for verifying the individual effect of each favorable feature in the above-described embodiment, but does not necessarily depart from the scope of the present invention and can be taken as one embodiment having another feature of the present invention.

Example 1-1

As Example 1-1, the stopper body 1 according to the above-described embodiment shown in FIGS. 1A and 1B, in which the projection 15 is formed at the upper end edge of the side wall 11 of the stopper body 1, was used.

Reference Example 1-1

As Reference Example 1-1, a stopper body in which a shape corresponding to the projection 15 of the stopper body 1 is not formed was used. The others are the same as in the stopper body 1.

(Test Method)

Samples of Example 1-1 and Reference Example 1-1 were prepared. An opening torque (N·cm) was measured immediately after each sample was set (the spout stopper was mounted onto a container body), immediately after a content liquid was filled (after 3 days from the setting, 70° C.), after 1 day from the filling, after 7 days from the filling, and after 14 days from the filling. The test results are shown in Table 1.

TABLE 1

| Opening torque (N · cm) | | Immediately after setting | After filling | After 1 day from filling | After 7 days from filling | After 14 days from filling |
|---|---|---|---|---|---|---|
| Example 1-1 | Maximum | 71 | 54 | 51 | 50 | 50 |
| | Minimum | 54 | 36 | 35 | 33 | 34 |
| | Average | 62 | 43 | 41 | 40 | 41 |
| Reference | Maximum | 75 | 51 | 48 | 46 | 45 |
| Example 1-1 | Minimum | 58 | 35 | 33 | 31 | 29 |
| | Average | 63 | 40 | 38 | 37 | 36 |

From Table 1, it is found that regarding the stopper body according to Reference Example 1-1, the opening torque tends to decrease after the filling. On the other hand, regarding the stopper body 1 according to the example, a great decrease in the opening torque is not observed even after 14 days from the filling. From the results, it was confirmed that the stopper body 1 according to Example 1-1 can maintain a state where the cap is less likely to become loosened, over a long period of time as compared to the stopper body according to Reference Example 1-1, and thus has higher sealing performance.

<Evaluation 2>

Example 2-1

Example 2-1 of the present invention is the spout stopper 3 according to the above-described embodiment whose cross-sectional view is shown in FIG. 4A. In Example 2-1, the external screw 12 is formed in a range from the connection position with the flange 16 to a height that is 60% of the distance between the connection position and the upper end edge. A polypropylene having a flexural modulus of 1470 MPa was used for the cap 2, and a low-density polyethylene having a flexural modulus of 120 MPa was used for the stopper body 1.

Example 2-2

In Example 2-2, the range where the external screw 12 is formed in Example 2-1 is changed, and the external screw 12 is formed in a range from the connection position with the flange 16 to a height that is 58.7% of the distance between the connection position and the upper end edge. L1 described above was set to 12.70 mm, and L2 described above was set to 7.45 mm.

Example 2-3

In Example 2-3, the range where the external screw 12 is formed in Example 2-1 is changed, and the external screw 12 is formed in a range from the connection position with the flange 16 to a height that is 55% of the distance between the connection position and the upper end edge. L1 described above was set to 14.34 mm, and L2 described above was set to 7.89 mm.

Reference Example 2-1

In Reference Example 2-1, the range where the external screw 12 is formed in Example 2-1 is changed, and the external screw 12 is formed in a range from the connection position with the flange 16 to a height that is 70% of the distance between the connection position and the upper end edge.

Reference Example 2-2

In Reference Example 2-2, the range where the external screw 12 is formed in Example 2-1 is changed, and the external screw 12 is formed in a range from the connection position with the flange 16 to a height that is 75% of the distance between the connection position and the upper end edge.

(Measurement of Overrun Occurrence Torque Value)

A torque by which overrun occurred was measured by using Examples 2-1 to 2-3 and Reference Examples 2-1 and 2-2. The cap was brought into threaded engagement with the side wall in an unused state, and a rotation load was applied until overrun occurred (the first time). After the overrun occurred, the threaded engagement of the cap was loosened, and a rotation load was applied again until overrun occurred (the second time). The measurement results obtained by carrying out this process for 10 spout stopper samples are shown in Table 2.

TABLE 2

| | | First time (N · cm) | | | Second time (N · cm) | | |
|---|---|---|---|---|---|---|---|
| | L2/L1 | Average | Maximum | Minimum | Average | Maximum | Minimum |
| Example 2-1 | 0.60 | 181.7 | 188 | 168 | 171.1 | 176 | 166 |
| Example 2-2 | 0.587 | 181.4 | 188 | 168 | 171.3 | 176 | 165 |
| Example 2-3 | 0.55 | 182.6 | 190 | 168 | 171.8 | 175 | 168 |
| Reference Example 2-1 | 0.70 | 179.6 | 187 | 166 | 174.3 | 183 | 163 |
| Reference Example 2-2 | 0.75 | 180.4 | 189 | 173 | 166.5 | 178 | 155 |

From the measurement results, it was confirmed that regarding Examples 2-1 to 2-3, the torque by which overrun occurred for the first time was higher, that is, overrun was less likely to occur, as compared to Reference Examples 2-1 and 2-2. In addition, a tendency that the torque by which overrun occurred for the second time decreased was observed in each case, but it was confirmed that regarding Examples 2-1 to 2-3, the amount of the decrease was smaller as compared to Reference Examples 2-1 and 2-2, and the torque value was similar to those of Reference Examples 2-1 and 2-2, so that overrun was not likely to occur as compared to Reference Examples 2-1 and 2-2.

(Evaluation of Liquid Leak at Occurrence of Overrun)

Performance regarding content liquid leak after occurrence of overrun was evaluated by using a packaging container to which each of Examples 2-1 to 2-3 and Reference Examples 2-1 and 2-2 was mounted. The partition of the stopper body according to each of Examples 2-1 to 2-3 and Reference Examples 2-1 and 2-2 was removed, and 1.8 liters of water was filled into the packaging container. Then, a rotation load was applied to the cap brought into threaded engagement with each side wall, until overrun occurred. The application of the load was stopped at the time when overrun occurred, and the cap and the spout stopper of the packaging container were directed downward to check presence/absence of water leak. Thereafter, the threaded engagement of the cap was loosened, then a rotation load by which overrun did not occur was applied this time to bring the cap into threaded engagement, and the cap and the spout stopper of the packaging container were directed downward with the cap being in threaded engagement, to check presence/absence of water leak. The evaluation results are shown in Table 3.

TABLE 3

| | L2/L1 | Number of cases with liquid leak immediately after overrun | Number of cases with liquid leak when tightening later |
|---|---|---|---|
| Example 2-1 | 0.60 | 9 out of 16 | 0 out of 16 |
| Example 2-2 | 0.587 | 9 out of 16 | 0 out of 16 |
| Example 2-3 | 0.55 | 9 out of 16 | 0 out of 16 |
| Reference Example 2-1 | 0.70 | 8 out of 8 | 0 out of 8 |
| Reference Example 2-2 | 0.75 | 8 out of 8 | 0 out of 8 |

From the evaluation results, it was confirmed that in Reference Examples 2-1 and 2-2, water leak was not prevented in all the cases in a state where overrun occurred, but in Examples 2-1 to 2-3, deformation of the side wall was small even in a state where overrun occurred, and water leak was prevented in 7 cases out of 16 cases, so that the sealability improved. In addition, it was confirmed that in each of Examples 2-1 to 2-3 and Reference Examples 2-1 and 2-2, water leak was prevented in all the cases by re-tightening the cap, and the examples can maintain sealability at substantially the same level by re-tightening after overrun, as compared to the conventional products.

<Evaluation 3>

Each of Examples 3-1 to 3-9 is the spout stopper 3 according to the above-described embodiment whose cross-sectional view is shown in FIG. 5A, and L3 and L4 described above satisfy L3<L4. In Reference Examples 3-1 and 3-2, L3>L4 is satisfied instead of L3<L4 in the spout stopper according to the embodiment. Among them, D1 and D2 described above satisfy D1<D2 in Examples 3-1, 3-2, 3-4, 3-5, 3-7, and 3-8 and Reference Examples 3-1 and 3-2, and satisfy D1>D2 in Examples 3-3, 3-6, and 3-9. In addition, in Examples 3-1, 3-4, and 3-7 and Reference Example 3-1, the guide portion was provided with a portion having an outer diameter increasing toward the lower end, and in Examples 3-2, 3-3, 3-5, 3-6, 3-8, and 3-9 and Reference Example 3-2, the guide portion was not provided with such a portion having an increasing outer diameter.

Whether insertion and threaded engagement of the cap to the stopper body smoothly advanced in each spout stopper without the cap being caught was evaluated. In the evaluation, ++ (excellent) was given when the number of times of smooth advance was 10 out of 10 trials, + (good) was given when the number of times was equal to or greater than 7, and poor (−) was given when the number of times was equal to or less than 6. The results are shown in Table 4.

TABLE 4

| | L3 (mm) | L4 (mm) | Relationship between D1 and D2 | Portion of guide portion having outer diameter increasing toward lower end | Evaluation results |
|---|---|---|---|---|---|
| Example 3-1 | 3.5 | 5.1 | D1 < D2 | Presence | ++ |
| Example 3-2 | 3.5 | 5.1 | D1 < D2 | Absence | + |
| Example 3-3 | 3.5 | 5.1 | D1 > D2 | Absence | + |
| Example 3-4 | 5.0 | 6.5 | D1 < D2 | Presence | ++ |
| Example 3-5 | 5.0 | 6.5 | D1 < D2 | Absence | + |
| Example 3-6 | 5.0 | 6.5 | D1 > D2 | Absence | + |
| Example 3-7 | 5.0 | 5.5 | D1 < D2 | Presence | ++ |
| Example 3-8 | 5.0 | 5.5 | D1 < D2 | Absence | + |
| Example 3-9 | 5.0 | 5.5 | D1 > D2 | Absence | + |
| Reference Example 3-1 | 5.7 | 3.0 | D1 < D2 | Presence | − |
| Reference Example 3-2 | 5.7 | 3.0 | D1 < D2 | Absence | − |

As shown in Table 4, the evaluation result was ++ or + in the case of L3<L4, and the evaluation result was—in the case of L3>L4. Therefore, the effect of the present invention was confirmed. In addition, in the case of L3<L4, when D1<D2 was satisfied and the guide portion was provided with a portion having an outer diameter increasing toward the lower end, the evaluation result was ++, and this was confirmed as being more preferable.

INDUSTRIAL APPLICABILITY

The present invention can be used for stopper bodies for various packaging containers such as a packaging container made of paper, a PET bottle, a bottle, and a flexible packaging container.

DESCRIPTION OF THE REFERENCE CHARACTERS

1 stopper body
11 side wall
12 external screw
13 first outer diameter portion
103 pull ring
104 partition
108 rib
109 top surface
113 guide portion
119 projection
13 first outer diameter portion
14 second outer diameter portion
141 half-cut
15 projection
16 flange
17 outer circumferential surface
18 cut-off portion
19 inner circumferential surface
2 cap
21 side wall
22 internal screw
23 inner circumferential surface
24 top plate
25 inner ring
26 thick portion
27 contact surface
28 contact portion
3 spout stopper
4 container body
5 packaging container

The invention claimed is:

1. A spout stopper comprising:

a stopper body including a cylindrical side wall having an external screw formed on an outer circumferential surface thereof; and a cap to be mounted from an upper end side that is one end of the side wall of the stopper body, the cap including a top surface and a side wall having an internal screw formed on an inner circumferential surface thereof, the external screw and the internal screw being configured to be brought into threaded engagement with each other, wherein a projection is formed at an upper end edge of the side wall of the stopper body so as to project outward from the side wall of the stopper body, a disc-shaped flange is formed at a lower end of the side wall of the stopper body so as to extend outward from a lower end edge of the side wall of the stopper body, the external screw is formed in a range along a screw axis direction from a connection position at which the side wall of the stopper body is connected to the flange to a distance that is not less than ⅓ of a distance between the connection position and the upper end edge and not greater than ⅔ of the distance between the connection position and the upper end edge, and in a state where the cap is threadedly attached to the side wall of the stopper body, a top surface at the upper end of the side wall of the stopper body and an upper surface of the projection are in surface contact with an inner surface of the top surface of the cap over an entire circumference thereof, and an outer circumferential edge of the projection is in contact with the inner circumferential surface of the side wall of the cap.

2. The spout stopper according to claim 1, wherein in the state where the cap is threadedly attached to the side wall of the stopper body, the side wall of the stopper body becomes elastically deformed, and the top surface at the upper end of the side wall of the stopper body is in surface contact with the cap at a certain contact pressure.

3. The spout stopper according to claim 1, wherein a material of the cap has higher rigidity than a material of the side wall of the stopper body.

4. The spout stopper according to claim 1, wherein the material of the cap has higher rigidity than a material of the stopper body.

5. The spout stopper according to claim 1, wherein the material of the cap is a polypropylene resin or a high-density polyethylene resin, and the material of the stopper body is a low-density polyethylene resin.

6. The spout stopper according to claim 1, wherein the cap includes an inner ring that is fitted to an inner circumferential surface of the side wall of the stopper body to seal the side wall of the stopper body in the state where the cap is threadedly attached to the side wall of the stopper body, and an upper end portion of the side wall of the stopper body is in surface contact with the cap over an entire circumference thereof between the inner ring and the side wall of the cap in the state where the cap is threadedly attached to the side wall of the stopper body.

7. The spout stopper according to claim 1, wherein at least one of the side wall of the stopper body and the side wall of the cap is tapered so as to spread from an upper end thereof toward a lower end thereof.

8. The spout stopper according to claim 1, wherein the outer circumferential surface of the side wall of the stopper body includes an external screw portion on which the external screw is formed, and a guide portion that is a region at an upper end side with respect to the external screw portion and on which the external screw is not formed, and a distance along the screw axis direction between a formation start position that is an upper end of the internal screw and a formation end position that is a lower end of the internal screw is shorter than a guide portion length that is a distance from the upper end edge of the side wall of the stopper body to a formation start position at an upper end side of the external screw portion.

9. The spout stopper according to claim 8, wherein the guide portion includes, at a lower end side with respect to the projection, a portion having an outer diameter increasing toward the external screw portion.

10. The spout stopper according to claim 8, wherein, in a state where the cap is fitted to the side wall of the stopper body along the screw axis, a distance between a screw thread ridge of the internal screw of the cap and an outer circumferential surface of the guide portion is longer than a distance between the inner circumferential surface of the cap and a screw thread ridge of the external screw portion of the side wall of the stopper body.

11. The spout stopper according to claim 1, further comprising:

a partition closing an interior of the side wall of the stopper body and having a half-cut formed at an outer peripheral portion;

a groove-shaped cut-off portion provided on a surface of the flange opposite to the side wall so as to be concentric with the side wall of the stopper body; and a plurality of ribs provided on an inner surface of the cut-off portion, wherein an interval between each of the plurality of ribs and the rib adjacent thereto along a circumferential direction of the cut-off portion is not less than 0.5 mm and not greater than 5.0 mm.

12. The spout stopper according to claim 11, wherein each of the plurality of ribs has a length, along the circumferential direction of the cut-off portion, of not less than 0.3 mm and not greater than 1.5 mm.

13. The spout stopper according to claim 11, wherein each of the plurality of ribs has a length, along the circumferential direction of the cut-off portion, of not less than 0.5 mm.

14. The spout stopper according to claim 11, wherein at least three projections are formed on the side wall of the stopper body at an upper end side with respect to the flange at circumferentially equal intervals so as to project outward.

15. The spout stopper according to claim 1, wherein the external screw and the internal screw are multiple-thread screws.

16. A packaging container comprising:

a container body; and the spout stopper according to claim 1, the spout stopper being mounted on the container body.

17. A spout stopper comprising:

a stopper body including a cylindrical side wall having an external screw formed on an outer circumferential surface thereof; and a cap to be mounted from an upper end side that is one end of the side wall of the stopper body, the cap including a top surface and a side wall having an internal screw formed on an inner circumferential surface thereof, the external screw and the internal screw being configured to be brought into threaded engagement with each other, wherein a projection is formed at an upper end edge of the side wall of the stopper body so as to project outward from the side wall of the stopper body, a disc-shaped flange is formed at a lower end of the side wall of the stopper body so as to extend outward from a lower end edge of the side wall of the stopper body, the external screw is formed in a range along a screw axis direction from a connection position at which the side wall of the stopper body is connected to the flange to a distance that is not less than ⅓ of a distance between the connection position and the upper end edge and not greater than ⅔ of the distance between the connection position and the upper end edge, and in a state where the cap is threadedly attached to the side wall of the stopper body, an upper surface of the side wall of the stopper body and an upper surface of the projection are in contact with an inner surface of the top surface of the cap over an entire circumference thereof, and an outer circumferential edge of the projection is in contact with the inner circumferential surface of the side wall of the cap.

* * * * *